US005108015A

United States Patent [19]

Rauworth et al.

[11] Patent Number: 5,108,015

[45] Date of Patent: Apr. 28, 1992

[54] MULTIPLE TUBE TO BUNG COUPLING

[75] Inventors: Barry L. Rauworth, Victoria; John Hennen, Eden Prairie, both of Minn.

[73] Assignee: Fluoroware, Inc., Chaska, Minn.

[21] Appl. No.: 549,279

[22] Filed: Jul. 6, 1990

[51] Int. Cl.[5] ..... B65D 83/00

[52] U.S. Cl. ..... 222/400.7; 137/212

[58] Field of Search ..... 222/400.7, 400.8, 400.5, 222/399; 137/212; 285/133.1, 138, 360, 361, 396, 401, 402

[56] References Cited

U.S. PATENT DOCUMENTS

| | | | |
|---|---|---|---|
| 655,672 | 8/1900 | Engel | 137/212 |
| 665,252 | 1/1901 | Morawetz | 137/212 |
| 729,145 | 5/1903 | Eckenwiler | 137/212 |
| 2,187,389 | 1/1940 | Winkler | 222/400.7 |
| 3,035,603 | 5/1962 | Jamieson et al. | 222/400.7 |
| 3,065,885 | 11/1962 | Chatlen | 137/212 |
| 3,361,152 | 1/1968 | Akers | 222/400.7 |
| 3,670,929 | 6/1972 | Berry | 222/400.7 |
| 3,774,820 | 11/1973 | Zucconi | 222/400.7 |
| 4,089,444 | 5/1978 | Shea | 222/400.7 |
| 4,732,414 | 3/1988 | Inaba | 285/133.1 |

*Primary Examiner*—Michael S. Huppert
*Assistant Examiner*—Anthoula Pomrening
*Attorney, Agent, or Firm*—Palmatier & Sjoquist

[57] ABSTRACT

A coupling connecting an array of tubes to a barrel and a plurality of flow courses in the barrel, the coupling having a head with multiple flow passages and a bung with multiple flow passages and interfitting with the head portion to form sealed annular flow passages connecting selected passages in the head and bung, regardless of the relative orientations of the bung and head when assembled, the circular interfitting portions having radial seals to isolate the flow passages; and a rotatable code ring on the head to fit with a stationary code ring on the bung.

25 Claims, 3 Drawing Sheets

MULTIPLE TUBE TO BUNG COUPLING

This invention relates to a coupling for connecting an array of liquid and gas carrying ducts or tubes with multiple flow courses in a container or barrel, and incorporating a coding to assure that coded barrels of liquid containing the wrong liquid will not be connected to the array of tubes.

BACKGROUND OF THE INVENTION

A known prior connection for connecting arrays of ducts or tubes to unique flow courses in a container is disclosed in U.S. Pat. No. 4,699,298. The prior coupling has had distinct disadvantages in that in order to seat the head portion connected to the array of tubes, into the bung portion on the container, it is necessary to rotate the head portion to the proper orientation, as to align the flow passages in the head and bung portions, and also as to align the coded rings on the head and bung portions. The continued rotation of the head portion as it is successively attached to a series of barrels puts undue strain on the stiff tubes and the welded joints connecting the tubes. The prior coupling utilizes a multiplicity of O-ring seals which interface between portions of substantially flat surfaces and surround the ports through which the liquids and gases pass. This arrangement of O-ring seals lacks the necessary integrity to consistently obtain the desired sealing between the head and bung portions of the connection. Other generally related prior disclosures, as in U.S. Pat. Nos. 3,287,031; 3,861,569; and 4,211,439 do not contribute to the solutions of the problems existing in the prior bung connection as described above.

SUMMARY OF THE INVENTION

An object of the invention is to provide a quick connect coupling between the bung of a container or barrel, and an array of ducts or tubes to obtain the correct connection between each tube and a counterpart passage in the bung, but without requiring rotating or reorienting the array regardless of the orientation of the container and bung.

Another object of the invention is to provide a quick connect coded coupling between a multiple port bung on a container or barrel and an array of ducts or tubes without requiring turning or rotating of the tube array in order to accommodate matching and assembling the coded portion on the bung and on the tube array.

Still another object of the invention is to provide a quick connect coded coupling between an array of tubes and a multi-passage bung of a container or barrel which permits the tube array portion of the coupling to be received onto the bung portion of the coupling only if prescribed coding matches, and without rotating the tube array to match the coding or to obtain correct connections between each tube and the counterpart passage in the bung portion.

A feature of the invention is a connector with a stationary bung portion and removable head portion to seat onto the bung portion. A plurality of annular radial seals between the bung and head portions define at least one annular interface passage between the bung and head portions and a second interface passage. Additional passages through the bung and head portions provide for liquid or gas flow. Assembly of the head portion with the bung portion may be accomplished without rotating the tube array connected to the head portion.

Another feature is the provision of a head portion connected to an array of tubes and assemblable onto the bung portion only if matching physical codes exist on a rotatable code ring and non-rotatable code ring. One ring is on the head portion and the other is on the bung portion. If matching codes exist on the two rings, the rotatable ring may be rotated and assembled with the other ring to permit assembly of the head and bung portions of the connector without requiring rotation or turning of the head portion to assemble the coded rings.

Still another feature is a connector with a multi-passage head portion which may be assembled with a multi-passage bung portion, connecting certain of the passages by way of sealed annular interface passages, and providing coded rotatable and stationary rings each respectively on one of the connector portions for limiting coupling of the portions without matching of the codes, but without requiring rotation or turning of the head portion to accommodate the coding on the multiple passages.

DETAILED SPECIFICATION

Figure 1:
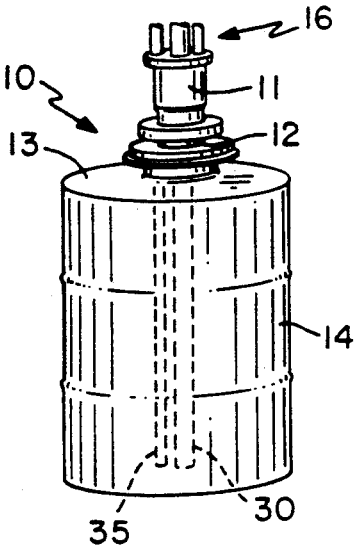
FIG. 1 is a perspective view of the coupling showing its use in connecting an array of tubes to a barrel.
Figure 1A:
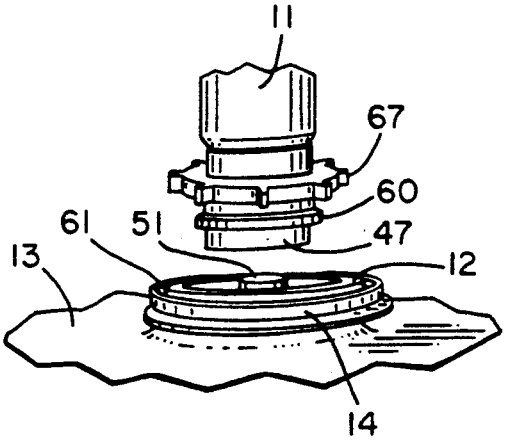
FIG. 1*a* is a perspective view of the coupling showing the head portion detached from the bung portion.

One form of the coupling 10 is illustrated in the drawings and is described herein.

The coupling 10 has a head or head portion 11 and a bung or bung portion 12. The bung portion 12 is to be fitted onto the lid or end wall 13 of a container or barrel 14 in which chemicals are stored and transported. The chemicals may be any of a number of types of materials, but those of particular importance would be chemicals useful in the processing of silicon wafers into integrated circuit chips, and accordingly, such chemicals may include hydrofluoric acid, and other strong acids and cleaning materials.

Both the head 11 and the bung 12 of the coupling are preferably formed by molding and are formed of plastics such as Teflon PFA, otherwise known as perfluoroalkoxy, as to be highly resistant to the corrosive effect of strong chemicals of the type which would be supplied in the drums or containers 14.

Although in some cases, the bung 12 might fit onto or into the opening in the lid or end wall 13 of the barrel, in many cases an adapter 14.1 will be provided that will conform to the shape and characteristics of the opening in the barrel end wall, and will also conform to the mounting threads 15 of the bung 12.

The head 11 is similarly molded of plastics that are highly resistant to the corrosive effect of strong chemicals and in the arrangement illustrated, the head 11 is actually molded in two parts, designated 11*a* and 11*b*, which are welded together along a weld line indicated by the numeral 11*c*. The head 11 is connected to the ends of an array 16 of gas and liquid flow tubes 17, 18 and 19. In the form illustrated in FIG. 2, the tubes 17–19 are connected with clamp-on fittings to the head 11. The tubes 17, 18 and 19 are typically extruded of Teflon PFA or other similar plastics which are highly resistant to the corrosive effect of strong chemicals. It is important that the tubes 17, 18 and 19 be handled as gently as is reasonably possible and that they should not be twisted or bent, under penalty of causing leakage of the liquids and gases that may be flowing.

The head 11 and bung 12 have cooperating assembly means, indicated in general by numeral 20, and including interfitting portions which are more specifically identified as circular insert means 21 in the head and circular socket means 22 in the bung.

The interfitting insert and socket means 20 and 21 have a series of coupling flow passages 23–28 through which the liquids and gases pass or are transferred when the coupling 10 is in operational assembly.

The main coupling flow passage 23 in head 11 extends along the axial centerline, and a corresponding main flow passage 24 is at the axial centerline of the bung 12 and when the coupling 10 is in operational assembly, the passages 23 and 24 are in flow communication with each other for drawing liquid from the container or barrel 14. The flow passage 23 extends upwardly through the head 11 and through a tube fitting 29 and is connected with the tube 18 in the array 16 of tubes. The flow passage 24 in the bung is in flow communication with one of the flow courses in the container or barrel 14 and as illustrated, a tube 30 is preferably welded onto the end of a short tube 31 forming a part of the bung 24 and defining a portion of the main flow passage 24.

Another of the coupling flow passages 25 in the head 11 is in flow communication with the coupling flow passage 26 in the bung 12 when the coupling 10 is in operational assembly. The coupling flow passages 25 and 26 are in flow communication with each other, by way of an annular interface or manifold flow passage 32 when the coupling 10 is in operational assembly. The flow passage 25 extends through the head 11 and through a tube fitting 33 for connection, by way of a clamp fitting, to the tube 19 which is part of the array 16 of tubes. A short length of tube 34, forming a portion of the bung 12, defines the coupling flow passage 26, and is connected as by welding to a tube 35 forming one of the flow courses which extend in the container or barrel 14.

A third coupling flow passage 27 in head 11 is in flow communication with a coupling flow passage 28 in the bung 12, by way of an annular interface or manifold flow passage 36. The flow passage 27 extends through head 11 and through the tube fitting 37 which connects to the tube 17 of the array 16 of tubes. The coupling flow passage 28 opens downwardly into the open space 38 below the bung 12 which is the same open space as in the barrel or container 14; and this open space 38 forms one of the flow courses to which gas or air is delivered when the coupling 10 is in operational assembly and connected to the intended array 16 of tubes.

In order to seal the main flow passages 23 and 24 from the annular interface or manifold flow passage 36, both of the head portion 11 and bung portion 12 are provided with annular conically tapered sealing surfaces 39, 40 which surround the center main flow passage 23 and interfit with each other in assembly to define an annular seal and seat 41 which not only provides the seal between the annular manifold flow passage 36 and the adjacent main flow passages 23, 24, but also provides a stop means to limit the movement of the insert portion 21 of the head 11 into the socket portion 22 of the seat 12. The seal and seat 41 provided by the interfitting tapered sealing surfaces 39, 40 maintain shoulder surfaces 42, 43 in spaced apart relation with each other so as to allow the annular manifold flow passage 36 to remain open. In addition, the seating provided by seal 41 maintains the annular and substantially flat surfaces 44 and 45 of the insert 21 and socket 22 in spaced relation with each other to keep the interface flow passage 32 open when the coupling 10 is in operational assembly.

Figure 2:
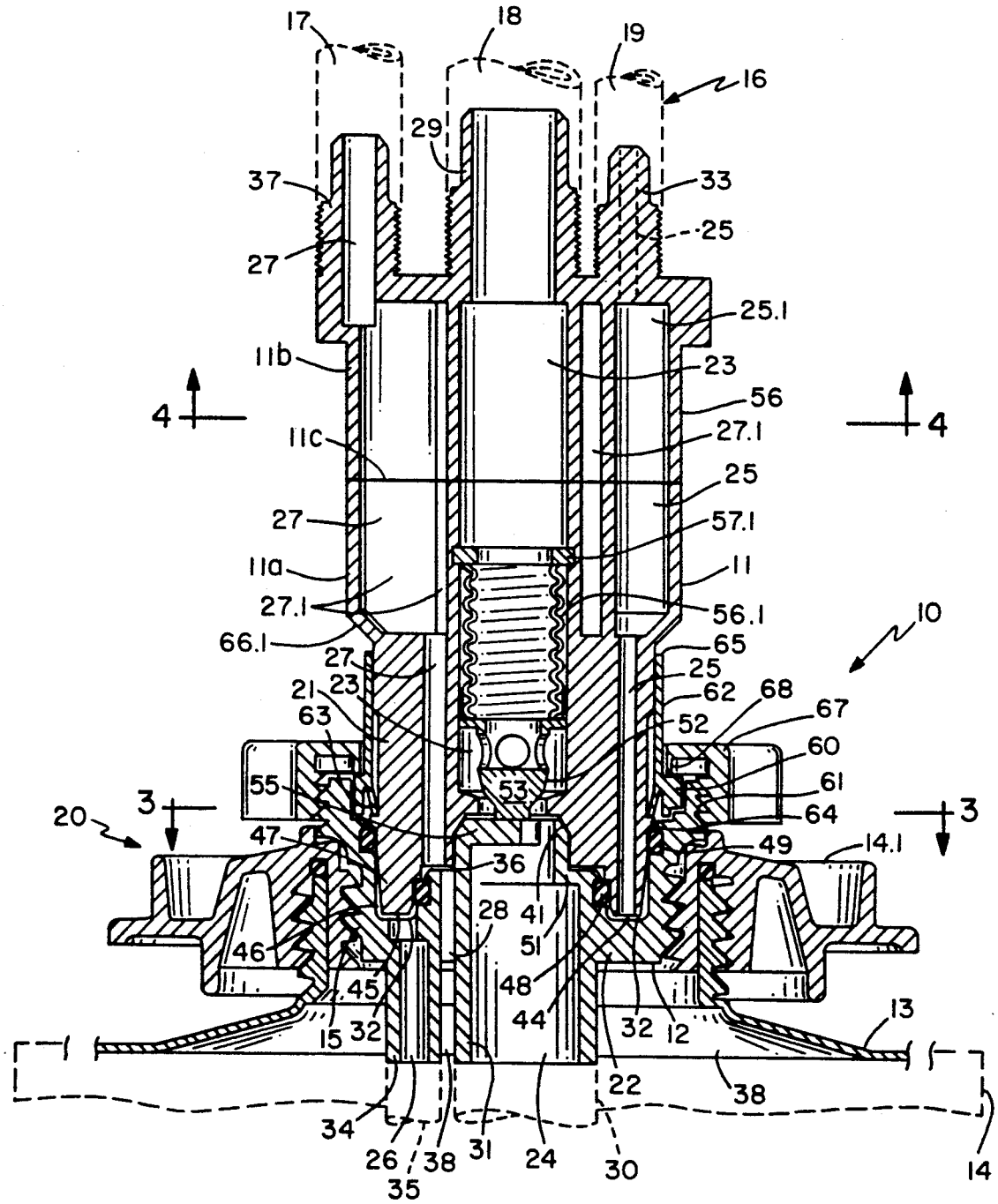
FIG. 2 is an enlarged section view through the coupling.

The interface flow passage 32 is defined, in part, by an annular groove 46 in the bung 12, and also in part by the annular insert 47 which is a part of the insert 21 and head 11. The annular side faces 46.1, 46.2 of the groove 46 in the socket portion 22 of the bung 12 are also annular surfaces, facing inwardly of the groove and toward the corresponding annular side faces 47.1, 47.2 of annular insert 47 of the head 11, and the side faces of the groove 46 carry O-rings 48, 49 which embrace and radially seal against the sides of the insert 47 when the insert is seated in the groove 46 and when the seal 41 is completed. When the coupling is in operational assembly, as illustrated in FIG. 2, the O-ring seals 48 and 49 isolate the coupling flow passages 25, 26 and interface passage 32 from the outside of the coupling, and also from the manifold flow passage 36 and the coupling flow passages 27 and 28 which communicate with the manifold flow passage 36.

It should be recognized that the substantially cylindrical cavity 50 in insert 21 and adjacent the tapered surface 39, forms a socket to receive the mating substantially cylindrical insert portion 51 of the bung 12. The insert 21 and insert portion 51 comprise aligned central portions through which the aligned coupling flow passages 23, 24 extend and communicate with each other.

A check valve assembly 52 has a poppet 53 which seats against a valve seat 54 when the head 11 is removed from the bung 12. Normally, the poppet 53 is held off the seat 54 by a spider 55 formed integrally of the insert portion 51 of the bung 12 and traversing the open end of flow passage 24. The spider 55 is three-sided and allows open space for the flow passage 24.

As a part of the check valve assembly 52, a plastic spring element 56.1 is anchored by a ring 57.1 in the head 11 to bear downwardly against the poppet 53 and maintain the check valve closed when the head 11 is removed from the bung 12.

Figure 4:
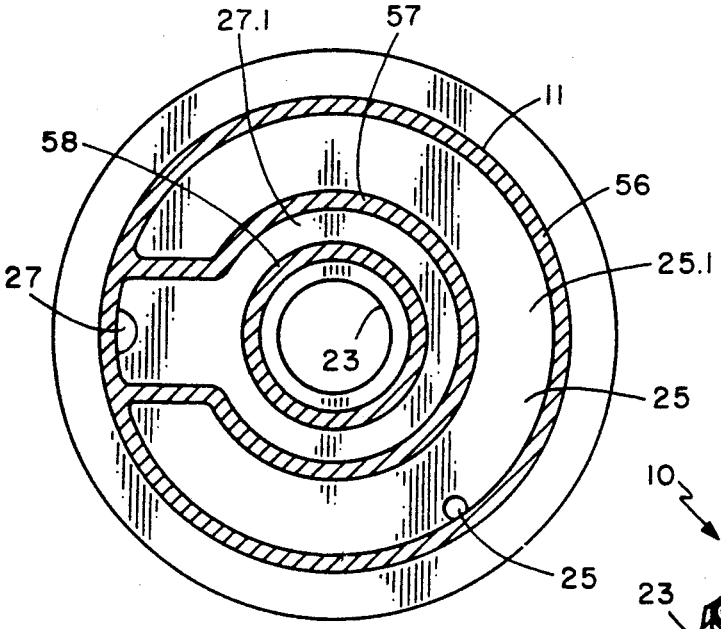
FIG. 4 is a detailed section view taken approximately at 4—4 of FIG. 2.

The head 11, in its upper portions, has wall portions 56 and 57 which define a partly annular chamber 25.1 as a portion of the coupling flow passage 25 in order to connect the portions of coupling flow passage 25 which pass through the fitting 33 and which open into the interface flow passage 32. Similarly, an inner peripheral wall 58 separates the inner coupling flow passage 23 from the adjacent flow passage 27. As seen in FIG. 4, it will be recognized that by reason of the shape of wall 57, the chamber 27.1 defined by the wall 57 and wall 58, is generally keyhole shaped for connecting the two ends of the coupling flow passage 27 passing through the fitting 37 and opening into the manifold flow passage 36.

The head 11 and bung 12 have coded interfitting code rings 60 and 61. The code ring 61 of bung 12 is formed integrally with the bung so as to be stationary thereon. The code ring 60 on the head 11 is formed of molded plastic and is rotatable around the head 11. Code ring 60 includes an elongate cylindrical sleeve 62 embracing the adjacent portion of head 11 to be rotatable thereon. The rotatable code ring 60 also includes a multiplicity of arcuate spring tabs 63 bearing inwardly against the cylindrical sidewall of the head, and also bearing against an annular rib 64 on the head 11 so as to prevent the code ring 60 from moving endways along the cylindrical portion of the head. Likewise, the upper end portion 65 of the sleeve 62 confronts the tapered shoulder surface 66.1 of the head 11 as to be prevented from moving along the head toward the shoulder surface 66.1.

Figure 3:
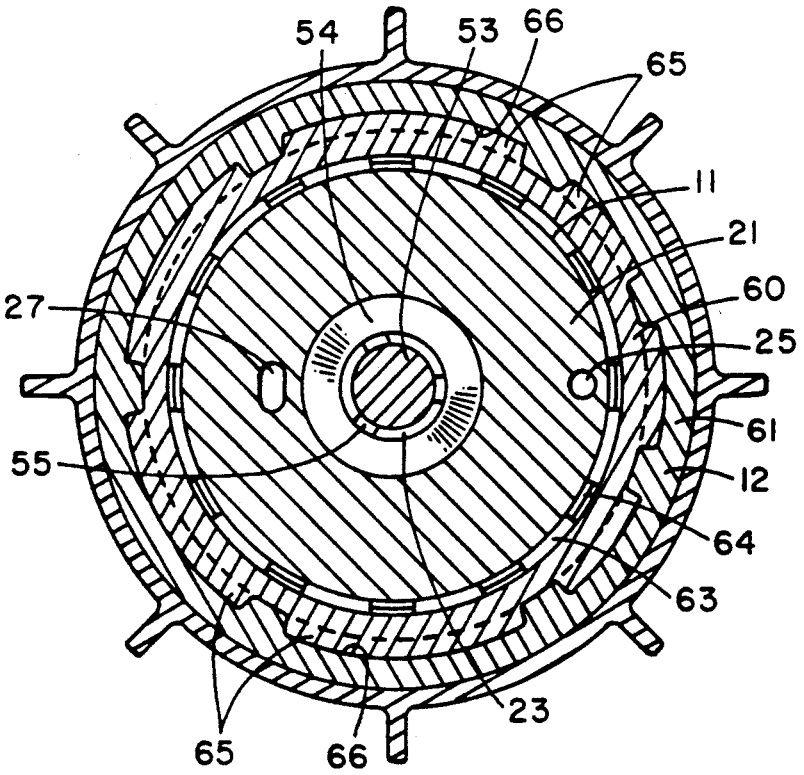
FIG. 3 is a detailed section view taken approximately at 3—3 in FIG. 2.

As best seen in FIG. 3, the tabs 63 bear inwardly against the head 11 and rest upon the annular rib 64. The rotatable code ring 60 has a multiplicity of lugs 65 arranged in a predetermined pattern; and the code ring. 61 of the bung 12 has a multiplicity of recesses 66 also arranged in a predetermined pattern as to fit the lugs 65. The lugs 65 fit into the recesses 66 in an endways direction of the cylindrical head 11 so that the rotatable code ring 60 fits into the stationary ring 61 in the manner illustrated in FIG. 2. A clamp ring 67 is also rotatably mounted on the cylindrical sleeve 62 of the code ring 60, and the clamp ring 67 is threaded to thread onto the exterior of the stationary code ring 61 of the bung 12. The clamp ring 67 has an annular flange 68 which bears against the code ring, to keep the code ring in assembly with the stationary code ring 61.

Figure 5:
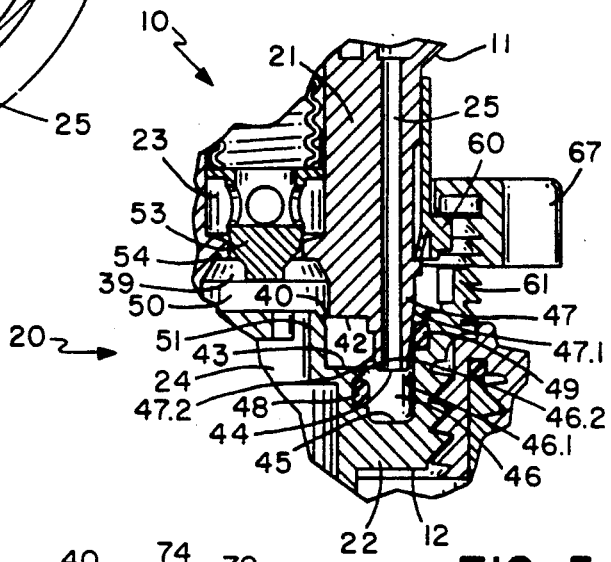
FIG. 5 is a detailed section view of a portion of the coupling in detached condition.

When the clamp ring 67 is removed or unthreaded from the stationary code ring 61 of the bung, the code ring may slide upwardly along the sleeve 62 of the rotatary code ring 60, and the head 11 and code ring 60 may be lifted off the bung 12, substantially as illustrated in FIG. 5.

If the stationary code ring 61 has the correct pattern arrangement of lugs and recesses to match the lug pattern of the rotatable code ring 60, the code ring 60 may be seated onto the stationary code ring 61 and the head 11 may be fully assembled with the bung 12, after which the clamp ring 67 will be threaded onto the exterior of the stationary code ring 61 of the bung.

However, in the event that the codes of the code rings 60 and 61 do not match, the lugs 65 of the rotary code ring will not mesh into the recesses of the stationary code ring 61, but the lugs 65 will merely sit on top of the adjacent portions of the stationary code ring 61, and under these circumstances, the clamp ring 67 will not be long enough to engage the threads of the stationary code ring 61 and the head may not be fully seated onto the bung of the barrel.

The person doing the assembly will then determine that the wrong barrel is being used in an attempt to attach it to the head 11, whereupon improper chemicals from the wrong drum will not be fed into the system attached to the array 16 of tubes 17–19.

Recognizing that the drums or barrels 14 of liquid chemical are large and heavy to be physically handled, the barrels will not always have the same orientation.

Regardless of the orientation of the barrel 14 and of the bung 12, the head 11 may be simply moved endways along its axis and inserted into the socket portion 22 of the bung without requiring the head to be rotated relative to its longitudinal axis. If the code rings match up, the head may simply be slipped into the bung portion 12 and when the code rings have been matched up and seated into each other and the insert portion 21 of the head has been inserted into the socket portion 22 of the bung, the radial seals provided by the O-rings 48, 49 will effectively isolate various areas of the interface and manifold passages 32 and 36 from each other and from the central passages 23, 24 and the coupling will thereby be complete.

In the normal use of the coupling 10, the seating of the head 11 onto the bung 12 will cause the poppet 53 of the check valve to lift off its seat so as to prepare for flow of the liquid upwardly through the tubes 30 and 18 and through the coupling flow passages 24, 23.

A source of gas under pressure is connected to the tube 19 and into the flow passages 25, 26 and into the tube 35, the end of which will be located adjacent the bottom of the barrel. When gas pressure causes the flow of gas in tube 35, and bubbling through the liquid in the barrel, the back pressure applied in tube 25 will be measured as to indicate the depth or quantity of liquid remaining in the barrel.

According to the present invention, neither the arrangement of the ports in the head and bung, nor the arrangement of the coded lugs on the code rings will require any adjustment as to the position of the head during the insertion of the head into the bung. The head may be simply moved straight into the bung without turning it about its own axis. The flow passages in the head and bung will be properly aligned by reason of the arrangement of the passages and the radial seals, and the rotatable code ring may be adjusted independently of the position of the head to be matched up with the same pattern of lugs and recesses on the stationary code ring.

Figure 6:
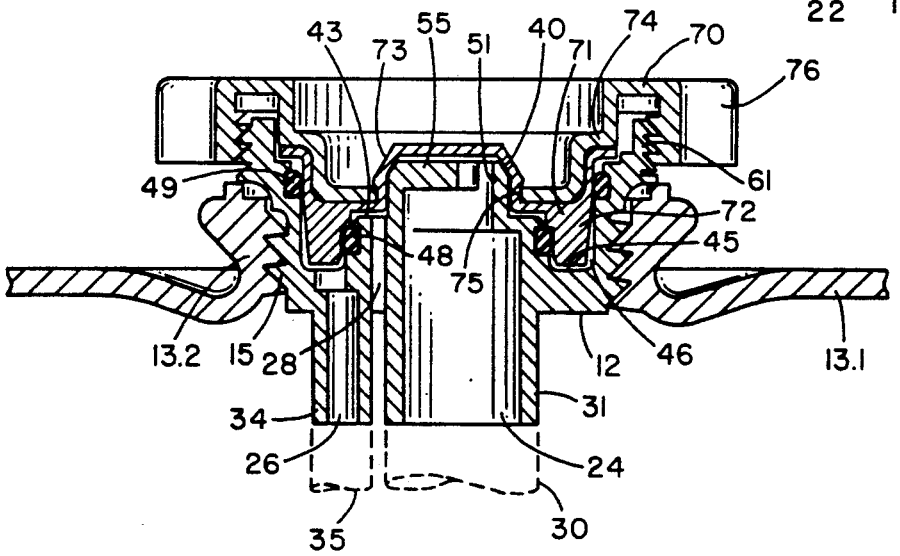
FIG. 6 is a detailed section view of the bung portion of the coupling provided with a sealing cover for shipping.

In FIG. 6, a slightly modified form of barrel lid or end wall 13.1 is illustrated and has a threaded collar 13.2 arranged slightly differently than the collar on the end wall 13 in FIG. 2. The arrangement in FIG. 6 illustrates that the bung portion 12 of the coupling 10 may be threaded directly into the collar 13.2 of the end wall 13.1 without the need for an adapter as illustrated in FIG. 2. Accordingly, various forms of barrel end walls and threaded collars may be used with the coupling 10 for substantially permanently mounting the bung 12 to which the tubes 30 and 35 are welded for defining the necessary flow courses within the barrel.

Also in FIG. 6, a shipping plug or cover 70 is illustrated, together with a plug liner 71 to close the several coupling flow passages 24, 26 and 28 of the bung 12 and to maintain them in closed condition for shipping the barrel. It will be recognized that the liner 71 has an annular insert 72 extending into the annular groove 46 and radially sealing against the O-ring seals 48, 49.

The central portion of the liner 71 has a conically tapered portion 73 embracing and sealing against the conically tapered sealing surface 40 of the bung 12 so as to entirely close the central coupling flow passage 24 and isolate the flow passage 24 from the adjacent flow passage 28.

The plug or cover 70 has a central portion 74 shaped to apply pressure onto the liner 71 to maintain the sealing relationship between the liner and the bung 12; and the central portion of the plug has an opening 75 therein receiving the central portion of the liner therein for drawing the liner firmly against the tapered sealing surface 40 of the bung portion 12.

The peripheral flange 76 of the plug 70 is threaded to thread onto the external threads of the stationary code ring 61 of the bung 12. The container may contain strong chemicals, and it has been found that Teflon PFA is suitable. The plug 70 does not come into contact with the contents of the barrel or drum, and accordingly may be molded of other plastic materials such as high density polyethylene.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

I claim:

1. A liquid and gas transferring coupling for quickly making discreet connections between an array of tubes and a cluster of flow courses, comprising a head portion comprising means for connection to such an array of tubes and comprising a plurality of coupling flow passages each adapted for flow communication with a certain tube, a bung portion assembled with the head portion and comprising a plurality of coupling flow passages each adapted for flow communication with a certain one of said flow courses, said head and bung portions comprising interfitting and guiding assembly means obtaining seating of said portions against each other in response to relative convergent movement of said portions during assembly thereof, said portions comprising a plurality of concentric annular seals between the assembled head and bung portions and also comprising an annular interface flow passage between a pair of seals, one of the coupling flow passages of each of the head and bung portions opening into the annular interface flow passage, and said head and bung portions also comprising means sealed from said annular interface passage and for connecting other of said coupling passages together.

2. A liquid and gas transferring coupling according to claim 1 wherein said assembly means comprises substantially circular insert and socket means interfitting with each other.

3. A liquid and gas transferring coupling according to claim 1 wherein the head and bung portions comprise annular surfaces between said annular seals, the annular surfaces on the head and bung portions confronting each other in spaced relation to define said annular interface flow passage.

4. A liquid and gas transferring coupling according to claim 1 wherein said head and bung portions comprise substantially aligned central portions with aligned coupling flow passages therethrough and communicating with each other.

5. A liquid and gas transferring coupling in accordance with claim 4 and check valve means in the head portion and closing the coupling flow passages in said central portions when the head portion is disassembled from the bung portion.

6. A liquid and gas transferring coupling according to claim 1 wherein said assembly means comprises annular side faces on the head and bung portions and facing transversely of said convergent movement during assembly of said portions, said annular seals bearing and sealing against said side faces.

7. A liquid and gas transferring coupling according to claim 1 wherein the head and bung portions comprise interfitting coded rings around said portions, one of said rings being rotatable to match the code of and assemble with the other of said rings.

8. A liquid and gas transferring coupling according to claim 7 wherein a rotatable clamp ring on one of said portions is threadably and removably connected onto the other of said portions.

9. A liquid and gas transferring coupling according to claim 1 wherein one of said portions comprises a circular socket and the other of said portions comprises a circular insert fitting into the socket, both of said portions having interfitting annular surfaces embracing each other concentrically of the axes of the socket and insert, said seals engaging and sealing against said interfitting surfaces.

10. A liquid and gas transferring coupling according to claim 9 wherein said portions also have spaced and confronting annular surfaces lying transversely of the axes of the socket and insert and defining said interface flow passage.

11. A liquid and gas transferring coupling according to claim 1 wherein one of said portions comprises a circular socket and the other of said portions comprises a circular insert fitting into the socket, both of said portions having spaced and confronting annular surfaces defining said interface flow passage, and stop means on said portions and engaging each other to limit movement of the insert into the socket to maintain the interface flow passage open.

12. A liquid and gas transferring coupling according to claim 11 wherein said confronting annular surfaces lie transversely of the axes of said circular socket and insert.

13. A liquid and gas transferring coupling according to claim 11 wherein the coupling flow passages of said portions extend through said confronting annular surfaces and communicate with the interface flow passage.

14. A liquid and gas transferring coupling according to claim 11 wherein said stop means comprises tapered annular surfaces surrounding the axes of the portions and seated one against the other.

15. A liquid and gas transferring coupling according to claim 14 wherein certain of said coupling flow passages of the insert and socket open into each other at a location spaced inwardly of said tapered annular surfaces.

16. A liquid and gas transferring coupling according to claim 1 wherein said head and bung portions have interfitting tapered annular surface portions seated against each other and forming one of said seals.

17. A liquid and gas transferring coupling according to claim 16 wherein certain of said coupling flow passages in each of the head and bung portions open into each other at locations spaced from and within said tapered annular surface portions.

18. A liquid and gas transferring coupling according to claim 1 wherein retainer means restrict movement of the rotatable coded portion along the rotation axis relative to either of the head or bung portions without corresponding relative movement between the head and bung portions.

19. A liquid and gas transferring coupling for quickly making discreet connections between an array of tubes and a cluster of flow courses, comprising a head portion comprising means for connection to such an array of tubes and comprising a plurality of coupling flow passages each adapted for flow communication with a certain tube, a bung portion comprising a plurality of coupling flow passages each adapted for flow communication with a certain one of said flow courses, said head and bung portions comprising circular interfitting portions, the bung portion comprising a socket with an outer peripheral wall and an annular socket groove adjacent the wall, the head portion comprising an annular insert fitting into the socket groove, there being an annular interface flow passage between the groove and insert, certain of the coupling flow passages of the head and bung portions opening into and communicating with the interface flow passage, O-ring seals around the inner and outer peripheral sides of the annular insert and sealing radially between the head and bung portions, the head portion also having a circular socket centrally thereof, and the bung portion also having a circular insert seated in said circular socket, the head and bung portions having interfitting tapered sealing surfaces around said circular socket and insert, certain of said coupling flow passages in the head and bung portions opening into each other through said circular insert and socket and spaced inwardly of the interfitted tapered sealing surfaces, said head and bung portions also having annular shoulder surfaces between the annular groove and circular insert of the bung portion, and between the annular insert and circular socket of the head portion, the shoulder surfaces of the head and bung portions being spaced from each other in confronting relation to define an annular manifold passage, certain of the coupling flow passages of the head and bung portions opening into and communicating with said manifold passage, and releasable retaining means holding the head and bung portions together.

20. A liquid and gas phase transferring coupling for quickly making multiple connections between an array of tubes and a unique cluster of flow courses, a head portion comprising means for connection to such an array of tubes and comprising a plurality of nonconcentric coupling flow passages, a bung portion comprising a plurality of nonconcentric coupling flow passages each adapted for flow communication with a certain one of said flow courses, said head and bung portions comprising interfitting and guiding assembly means obtaining seating of said portions against each other in response to relative convergent linear and aligned movement and also obtaining connection of the coupling flow passages of the head and bung portions, the head and bung portions having interfitting and coded lug and recess portions arranged to interfit in response to such relative convergent linear movement of the head and bung portions, said lug and recess portions having unique patterns to allow interfitting with only lug and recess portions of identical patterns, and one of the coded portions being rotatable relative to the head and bung portions to accommodate marching of lug and recess unique patterns without requiring repositioning of the head and bung portions relative to each other.

21. A liquid and gas transferring coupling according to claim 20 wherein a clamp ring retains the coded portions in assembly and holds the head and bung portions together.

22. A liquid and gas transferring coupling according to claim 20 wherein said interfitting and guiding assembly means comprises circular interfitting insert and socket means defining annular interface passages and passages separating seals making discreet connections between the several coupling passages in the head and bung portions without regard to their orientation rotationally about the linear direction of assembly.

23. A liquid and gas transferring coupling for quickly making multiple connections between an array of tubes and a unique cluster of flow courses, a head portion comprising means for connection to such an array of tubes and comprising a plurality of nonconcentric coupling flow passages, a bung portion comprising a plurality of nonconcentric coupling flow passages each adapted for flow communication with a certain one of said flow courses, said head and bung portions comprising interfitting and guiding assembly means obtaining seating of said portions against each other in response to relative convergent linear and aligned movement and also obtaining connection of the coupling flow passages of the head and bung portions, the assembly means providing discreet connection between the coupling flow passages in the head portion and corresponding coupling flow passages in the bung portion without regard to orientation of said portions rotationally relative to the direction of relative convergent linear movement beween said portions, a pair of interfitting code ring portions, one of said ring portions being on the head portion, the other of the ring portions being on the bung portion, one of said ring portions being stationary and the other of said ring portions being rotatable to accommodate orienting the ring portions for matching their codes without moving the head or bung portions.

24. A liquid and gas transferring coupling according to claim 23 wherein the assembly means of the head portion and bung portion comprises interfitting circular insert and socket portions assemblable and removable in a direction along the axes of the head and bung portions, the rotatable code ring portion embracing the head portion and engaging the head portion to be limited in movement thereon in a direction along the axis of the head and bung portions, and a clamp ring portion threaded onto the bung portion and bearing on the rotatable code ring portion to maintain the code ring portions in assembly and to retain the head and bung portions in assembly.

25. A liquid and gas transferring coupling in accordance with claim 23 wherein the stationary code ring portion surrounds the rotatable code ring portion.

* * * * *

UNITED STATES PATENT AND TRADEMARK OFFICE

CERTIFICATE OF CORRECTION

PATENT NO. : 5,108,015

DATED : April 28, 1992

INVENTOR(S) : John Hennen and Barry L. Rauworth

It is certified that error appears in the above-identified patent and that said Letters Patent is hereby corrected as shown below:

On the title page, under item [19], change "Rauworth" to -- Hennen--; and in item [75], correct the order in which applicants names appear as follow:

--John Hennen, Eden Prairie;
Barry L. Rauworth, Victoria, both of Minn.--

Signed and Sealed this

Fourteenth Day of July, 1992

*Attest:*

DOUGLAS B. COMER

*Attesting Officer*

*Acting Commissioner of Patents and Trademarks*